US010431396B2

(12) United States Patent
Gottschalk et al.

(10) Patent No.: US 10,431,396 B2
(45) **Date of Patent: *Oct. 1, 2019**

(54) CHARGING RAM ASSEMBLY, AND PIN ASSEMBLY AND SECURING METHOD THEREFOR

(71) Applicant: EATON CORPORATION, Cleveland, OH (US)

(72) Inventors: Andrew Lawrence Gottschalk, Monaca, PA (US); Neil Andrew Buzzard, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 88 days.

This patent is subject to a terminal disclaimer.

(21) Appl. No.: 15/808,985

(22) Filed: Nov. 10, 2017

(65) Prior Publication Data

US 2018/0068806 A1 Mar. 8, 2018

Related U.S. Application Data

(63) Continuation of application No. 15/003,264, filed on Jan. 21, 2016, now Pat. No. 9,905,379.

(51) Int. Cl.
*H01H 3/30* (2006.01)

(52) U.S. Cl.
CPC ..... *H01H 3/3052* (2013.01); *H01H 3/3005* (2013.01); *H01H 3/3015* (2013.01)

(58) Field of Classification Search
CPC ... H01H 3/3052; H01H 3/3005; H01H 3/3015
USPC ..... 200/400, 401; 335/16
See application file for complete search history.

(56) References Cited

U.S. PATENT DOCUMENTS

| | | | | |
|---|---|---|---|---|
| 6,212,746 | B1 * | 4/2001 | Cooks, Jr. ..... | B23P 19/084 29/225 |
| 7,294,804 | B1 | 11/2007 | Gottschalk et al. | |
| 7,449,652 | B2 | 11/2008 | Rakus et al. | |
| 7,449,653 | B2 | 11/2008 | Gibson et al. | |
| 7,518,076 | B1 | 8/2009 | Gottschalk et al. | |
| 7,633,031 | B2 | 12/2009 | Wehrli, III et al. | |
| 7,696,448 | B2 | 4/2010 | Rakus et al. | |
| 8,058,580 | B2 | 11/2011 | Gottschalk et al. | |
| 8,063,328 | B2 | 11/2011 | Gottschalk et al. | |
| 8,319,133 | B2 | 11/2012 | Gottschalk et al. | |
| 8,519,289 | B2 | 8/2013 | Schaltenbrand et al. | |
| 8,642,905 | B2 | 2/2014 | Gottschalk et al. | |
| 9,905,379 | B2 * | 2/2018 | Gottschalk ..... | H01H 3/3052 |

(Continued)

*Primary Examiner* — Kyung S Lee
*Assistant Examiner* — Iman Malakooti
(74) *Attorney, Agent, or Firm* — Eckert Seamans Cherin & Mellott, LLC

(57) ABSTRACT

A pin assembly is for a charging ram assembly of an electrical switching apparatus. The charging ram assembly has a biasing element, a ram member structured to bias the biasing element, and a plate member. The pin assembly includes a pin member structured to extend through the biasing element and the plate member, the pin member having an end portion;

a first collar member and a second collar member coupled to the end portion; and a securing apparatus including a retaining member coupled to the first collar member and the second collar member in order to prevent the pin member from moving with respect to the first collar member and the second collar member.

18 Claims, 7 Drawing Sheets

(56) References Cited

U.S. PATENT DOCUMENTS

| | | | | |
|---|---|---|---|---|
| 2008/0257702 | A1* | 10/2008 | Weister | H01H 71/505<br>200/400 |
| 2012/0273333 | A1* | 11/2012 | Miller | H01H 31/003<br>200/400 |
| 2013/0134020 | A1* | 5/2013 | Gottschalk | H01H 3/3015<br>200/400 |
| 2015/0332871 | A1* | 11/2015 | Gottschalk | H01H 1/00<br>200/238 |

* cited by examiner

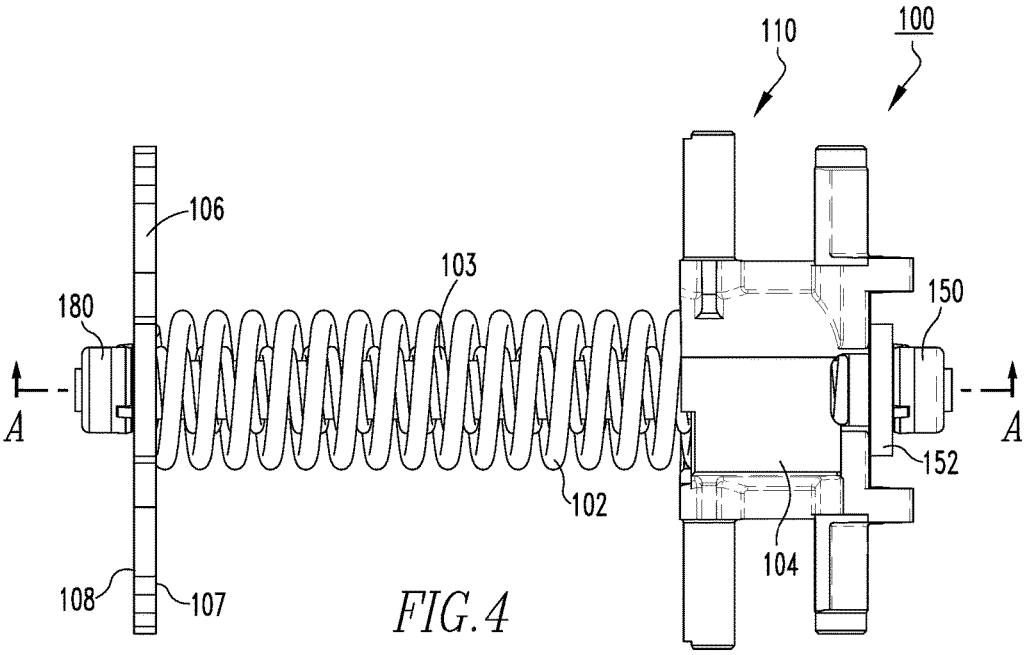
FIG.4
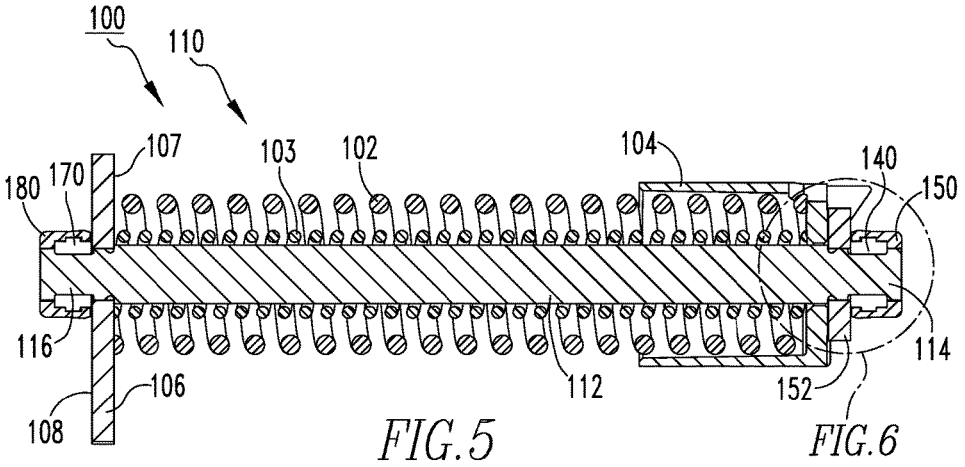
FIG.5
FIG.6

CHARGING RAM ASSEMBLY, AND PIN ASSEMBLY AND SECURING METHOD THEREFOR

CROSS-REFERENCE TO RELATED APPLICATION

This application is a continuation application of and claims priority to U.S. patent application Ser. No. 15/003,264, filed Jan. 21, 2016, and entitled "CHARGING RANI ASSEMBLY, AND PIN ASSEMBLY AND SECURING METHOD THEREFOR."

BACKGROUND

Field

The disclosed concept relates to charging ram assemblies for electrical switching apparatus, such as, for example, circuit breakers. The disclosed concept also relates to pin assemblies for charging ram assemblies. The disclosed concept further relates to methods of securing pin members within charging ram assemblies.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contacts to interrupt the flow of current through the conductors of an electrical system in response to such fault conditions as detected, for example, by a trip unit. The electrical contacts include stationary electrical contacts and corresponding movable electrical contacts that are separable from the stationary electrical contacts.

Among other components, the operating mechanisms of some low and medium voltage circuit breakers, for example, typically include charging ram assemblies that are used to store potential energy and release the potential energy to close the electrical contacts. The charging ram assemblies of many known circuit breakers commonly include a ram member, a guide pin, and a nut. During assembly, the nut is torqued onto an end of the guide pin and then riveted to hold the nut in place. In order to use the riveting process, the hardness of the guide pin must be undesirably limited. Because of the reduced hardness to accommodate the riveting process, mechanical endurance testing has shown that the rivet fails earlier than desired. More specifically, the force of the ram member causes the threads of the relatively soft guide pin to break or deform, causing the nut to slide with respect to the guide pin and the entire assembly to elongate. As a result, the ram member over-travels beyond its desired finish location and causes rigid components in the circuit breaker to be undesirably impacted.

There is thus room for improvement in charging ram assemblies, and in pin assemblies and securing methods therefor.

SUMMARY

These needs and others are met by embodiments of the disclosed concept, which are directed to a charging ram assembly, and pin assembly and securing method therefor, in which a pin member is reliably secured in the charging ram assembly by a plurality of collar members and a securing apparatus.

In accordance with one aspect of the disclosed concept, a pin assembly for a charging ram assembly of an electrical switching apparatus is provided. The charging ram assembly has a biasing element, a ram member structured to bias the biasing element, and a plate member. The pin assembly includes a pin member structured to extend through the biasing element and the plate member, the pin member having a first end portion and a second end portion located opposite and distal from the first end portion; a first collar member and a second collar member coupled to the first end portion; and a securing apparatus including a retaining member coupled to the first collar member and the second collar member in order to prevent the pin member from moving with respect to the first collar member and the second collar member.

In accordance with another aspect of the disclosed concept, a charging ram assembly for an electrical switching apparatus is provided. The charging ram assembly comprises a biasing element; a ram member structured to bias the biasing element; a plate member; and a pin assembly comprising a pin member extending through the biasing element and the plate member, the pin member having a first end portion and a second end portion located opposite and distal from the first end portion, a plurality of collar members comprising a first collar member and a second collar member, the first collar member and the second collar member being coupled to the first end portion, and a securing apparatus comprising a retaining member coupled to the first collar member and the second collar member in order to prevent the pin member from moving with respect to the first collar member and the second collar member.

In accordance with another aspect of the disclosed concept, a method of securing a pin member within a charging ram assembly of an electrical switching apparatus is provided. The charging ram assembly comprises a biasing element, a ram member structured to bias the biasing element, and a plate member. The method comprises the steps of providing a pin assembly comprising the pin member, a first collar member, a second collar member, and a retaining member, the pin member having a first end portion and a second end portion located opposite and distal from the first end portion; extending the pin member through the biasing element and the plate member; disposing the first collar member and the second collar member on the first end portion; and coupling the retaining member to the first collar member and the second collar member in order to prevent the pin member from moving with respect to the first collar member and the second collar member.

BRIEF DESCRIPTION OF THE DRAWINGS

A full understanding of the disclosed concept can be gained from the following description of the preferred embodiments when read in conjunction with the accompanying drawings in which:

FIG. 4 is a top plan view of the charging ram assembly and pin assembly therefor of FIG. 2;

FIG. 5 is a section view of the charging ram assembly and pin assembly therefor of FIG. 4, taken along line A-A of FIG. 4;

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
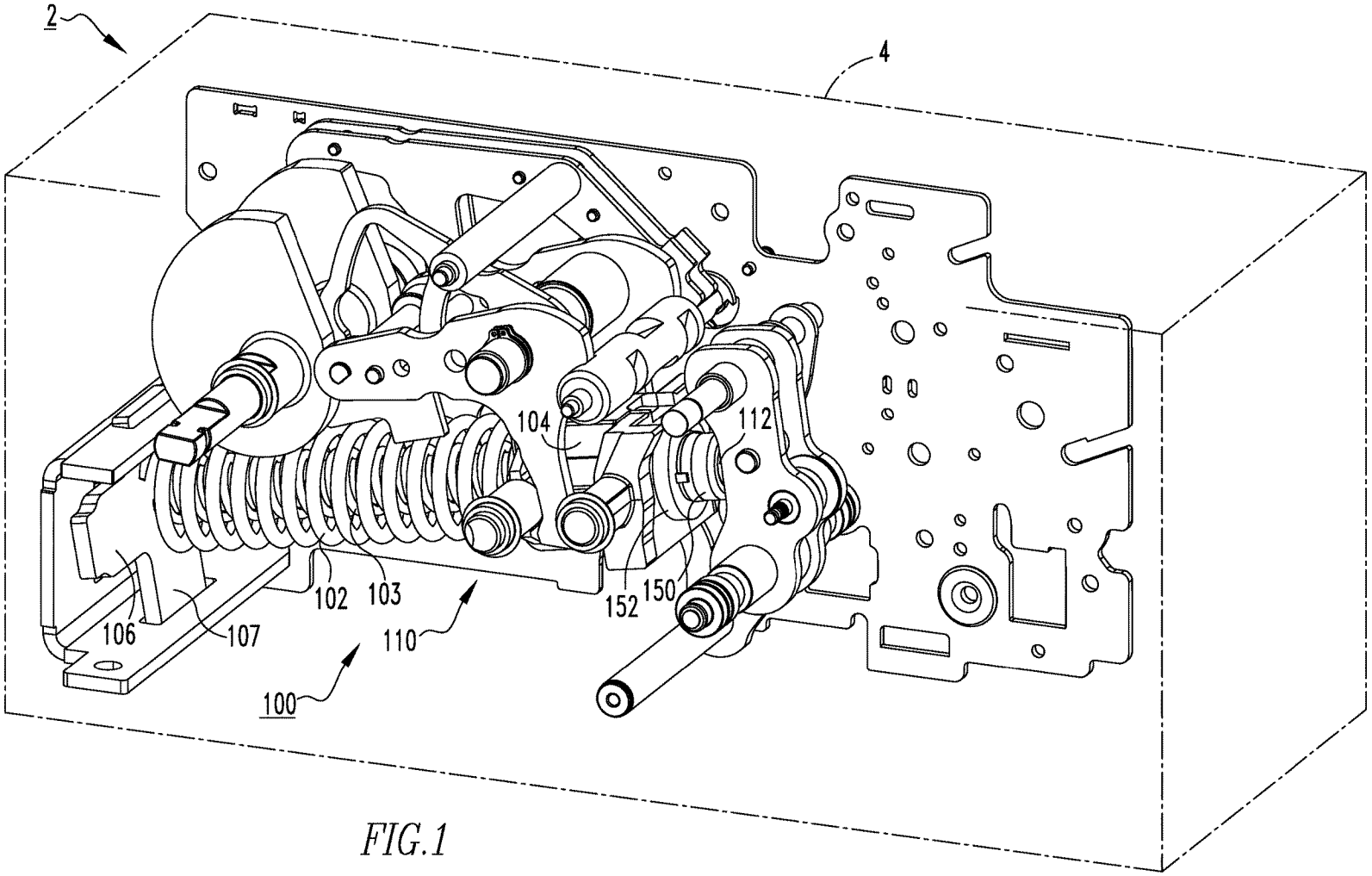
FIG. 1 is a front isometric view of an electrical switching apparatus, in accordance with a non-limiting embodiment of the disclosed concept, with the housing of the electrical switching apparatus shown in simplified form.

FIG. 1 shows a partially simplified view of an electrical switching apparatus (e.g., without limitation, circuit breaker 2). The example circuit breaker 2 has a housing 4 (shown in simplified form in phantom line drawing) and a charging ram assembly 100 located internal the housing 4. The charging ram assembly 100 stores potential energy that facilitates closing the circuit breaker 2 when released.

Figure 2:
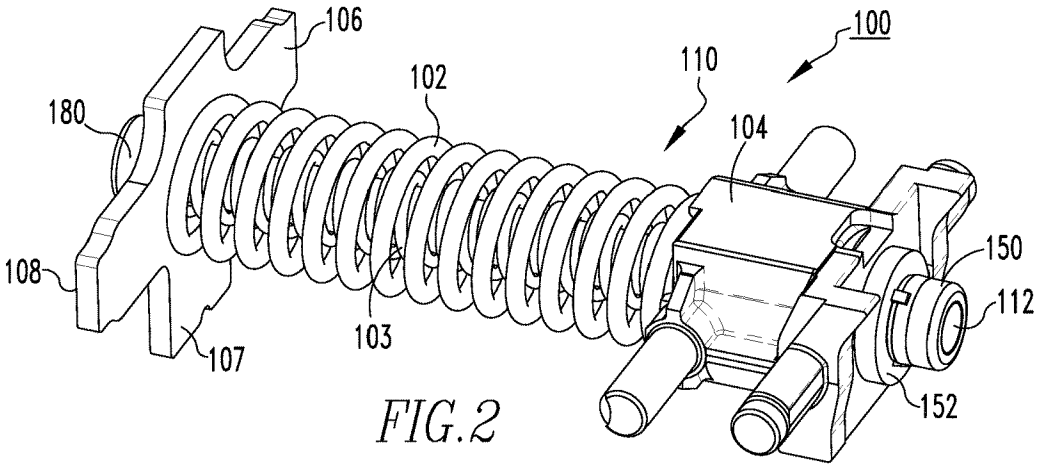
FIG. 2 is a front isometric view of a charging ram assembly and pin assembly therefor for the electrical switching apparatus of FIG. 1.
Figure 3:
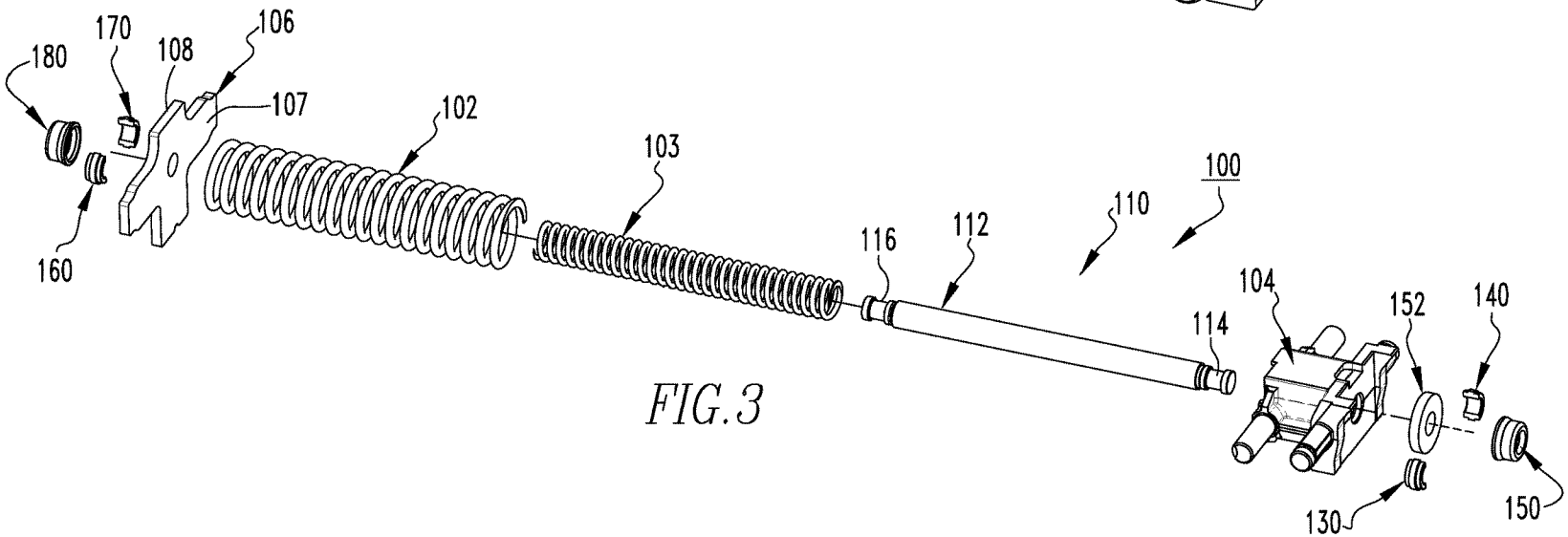
FIG. 3 is an exploded front isometric view of the charging ram assembly and pin assembly therefor of FIG. 2.

As shown in FIGS. 2 and 3, the charging ram assembly 100 includes a number of biasing elements (e.g., without limitation, springs 102,103), a ram member 104 and a plate member 106 that together bias the springs 102,103, and a pin assembly 110. In operation, the springs 102,103 are in compression and exert relatively large biasing forces on the ram member 104 and the plate member 106. The pin assembly 110 includes a pin member 112 extending through the springs 102,103, the ram member 104, and the plate member 106. As will be discussed in greater detail below, the pin assembly 110 is structured to reliably secure the pin member 112 within the charging ram assembly 100. This is distinct from known charging ram assemblies (not shown) in which repeated use often causes pin members to detach from securing components, resulting in significant damage to other important circuit breaker components. Accordingly, the disclosed charging ram assembly 100 significantly improves endurance reliability for the circuit breaker 2, as compared to known charging ram assemblies (not shown).

The pin member 112 has a pair of opposing end portions 114,116, and the springs 102,103, the ram member 104, and the plate member 106 are located between the end portions 114,116. Referring to FIG. 3, the pin assembly 110 further includes a novel mechanism that allows the pin member 112 to be retained in the charging ram assembly 100. The mechanism preferably includes a plurality of semi annular-shaped collar members 130,140,160,170 coupled to the respective end portions 114,116, and a securing apparatus to secure the collar members 130,140,160,170 to the respective end portions 114,116. In the example embodiment, the collar members 130,140,160,170 do not engage each other, thereby allowing them to advantageously be partially located inside the pin member 112 and thus prevent the pin member 112 from moving with respect to the collar members 130,140,160,170, as will be discussed below. The securing apparatus is in the form of a pair of retaining members 150,180 and a washer 152. It will be appreciated that a suitable alternative pin assembly (not shown) may include an additional washer on the end portion 116, or not include any washers, without departing from the scope of the disclosed concept. The collar members 130,140,160,170 and the retaining members 150,180 are not threadably connected to the pin member 112, distinct from prior art assemblies (not shown) that rely on threaded nuts and rivets. This provides material advantages for the pin member 112, as will be discussed below. Additionally, each respective pair of collar members 130,140,160,170 is concave facing each other, allowing for a relatively smooth connection with the pin member 112. That is, the first collar members 130,160 are concave facing the second collar members 140,170, and the second collar members 140,170 are concave facing the first collar members 130,160.

The collar members 130,140,160,170 prevent the ram member 104 and the plate member 106 from moving beyond the end portions 114,116, and the retaining members 150, 180 prevent the pin member 112 from moving with respect to the collar members 130,140,160,170. This is advantageous because there are significant forces in the charging ram assembly 100 that might otherwise cause the charging ram assembly 100 to become undesirably disassembled. For example and without limitation, the springs 102,103 are in compression and exert relatively large longitudinal forces on the ram member 104 and the plate member 106. Additionally, the impact by the ram member 104 on the washer 152 when the ram member 104 is released imparts significant stresses to the charging ram assembly 100. As will be discussed below, by employing the collar members 130,140, 160,170 and the retaining members 150,180, the compressive forces of the springs 102,103 and the impact of the ram member 104 will not cause the charging ram assembly 100 to disassemble after repeated use.

Figure 6:
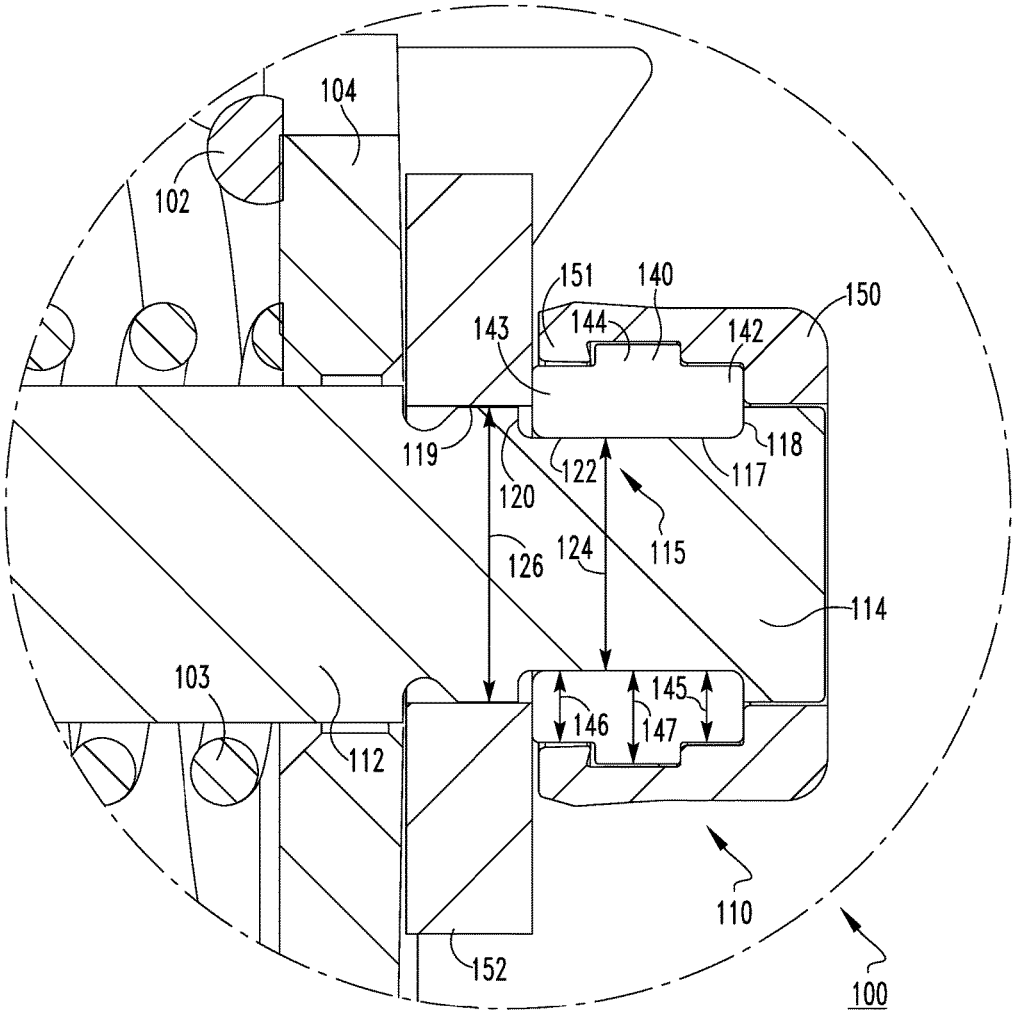
FIG. 6 is an enlarged view of a portion of the charging ram assembly and pin assembly therefor of FIG. 5.

FIG. 4 shows a top plan view of the charging ram assembly 100, and FIGS. 5 and 6 show section views of FIG. 4. As best shown in FIG. 6, the end portion 114 has an annular-shaped grooved region 115 having adjacent regions 117,119 that extend from each other. The regions 117,119 each have a respective diameter 124,126, and the second diameter 126 is greater than the first diameter 124. The collar members 130,140 are located in and are concentric with (i.e., have a common radial center point) the first region 117, and the washer is located in and is concentric with the second region 119. By employing the grooved region 115, the collar members 130,140 are able to secure the ram member 104 within the charging ram assembly 100. That is, without the engagement between the collar members 130, 140 and the grooved region 115, the biasing forces of the springs 102,103 would cause the ram member 104 to move past the end portion 114. This is a significant problem in known charging ram assemblies (not shown) in which failure of a riveted nut mechanism allows ram members to over-travel and cause undesirable damage to other circuit breaker components.

Continuing to refer to FIG. 6, the first region 117 includes two opposing disc-shaped surfaces 118,120 and a cylindrical-shaped surface 122 extending between and being perpendicular to the surfaces 118,120. The collar members 130,140 are flush with the surfaces 118,122 to prevent the pin member 112 from moving with respect to the collar members 130,140. In turn, the ram member 104 is reliably retained within the charging ram assembly 100. More specifically, in the orientation of FIG. 6, the springs 102,103 bias the ram member 104 to the right. The ram member 104 in turn engages the washer 152, which exerts a force on the collar members 130,140, which exert a force on the surface 118 to the right (from the perspective shown). The corresponding opposing normal force exerted on the collar members 130,140 by the surface 118 to the left (from the perspective shown) advantageously prevents any undesired movement of the ram member 104 to the right and past the end portion 114. By employing multiple collar members 130,140, the collar members 130,140 are able to be located in the region 117 and engage the surfaces 118,122, as opposed to a single continuous collar member (not shown) which would be required to be spaced from the surfaces 118,122 by virtue of the need to have a relatively large inner diameter to fit over the end portion 114.

It will be appreciated that the collar members 160,170 likewise prevent the plate member 106 from moving past the end portion 116. In this manner, the plate member 106 is able to constantly maintain its position in the charging ram assembly 100 after repeated use. For example, the plate member 106 has a pair of parallel surfaces 107,108 that face away from each other. The first surface 107 faces and engages the springs 102,103, and the second surface 108 faces and engages the collar members 160,170. Referring again to FIG. 5, the springs 102,103 bias the plate member 106 to the left. The surface 108 in turn exerts a force on the collar members 160,170 to the left. The corresponding opposing normal force exerted on the collar members 160, 170 by the grooved region (shown but not indicated) of the end portion 116 to the right advantageously prevents undesired motion of the plate member 106 to the left and past the end portion 116.

The geometry and orientation of the collar members 130,140,160,170 and the retaining members 150,180 allow the collar members 130,140,160,170 to be secured to the respective end portions 114,116. More specifically, and with reference to FIG. 6, the collar member 140 has a pair of opposing disc-shaped portions 142,143 and a disc-shaped portion 144 extending between the portions 142,143. The portions 142,143 each have a respective width 145,146, and the portion 147 has a width 147 greater than the widths 145,146. As seen, the retaining member 150 engages each of the portions 142,143,144, thus pressing the collar member 140 (i.e., and the collar member 130) radially inwardly into the first region 117. Additionally, the retaining member 150 is prevented from being pulled off of the collar member to the right, with respect to the orientation of FIG. 6. More specifically, the collar member 150 has a hook portion 151 that if pressed to the right, with respect to the orientation of FIG. 6, would latch onto the relatively wide portion 144 and prevent the retaining member 150 from being removed. Furthermore, the collar members 160,170 and the retaining member 180 have the same geometry and are coupled to the end portion 116 in substantially the same manner as the collar members 130,140 and the retaining member 150, respectively.

As a result of the novel securing mechanism, the pin member 112 is able to be significantly harder than prior art pin members (not shown). More specifically, the pin member 112 preferably has a Rockwell Hardness greater than RC 45. This is significantly harder than prior art pin members (not shown), which typically have a relatively limited hardness. More specifically, prior art pin members (not shown) have Rockwell Hardness's that are less than RC 40 because a harder pin member would not be able to be deformed by riveting. Accordingly, by employing the relatively hard pin member 112, fatigue strength is significantly improved in that the onset of any fracture, if at all, would not occur until after significantly more cycles of operation than a prior art pin member (not shown) having a softer hardness. It follows that the longer lasting pin member 112 advantageously lengthens the life of the entire circuit breaker 2. More specifically, in operation, the charging ram assembly 100 will not experience damaging problems such as over-travel of the ram member 104 that commonly occur in prior art circuit breakers (not shown).

Figure 7:
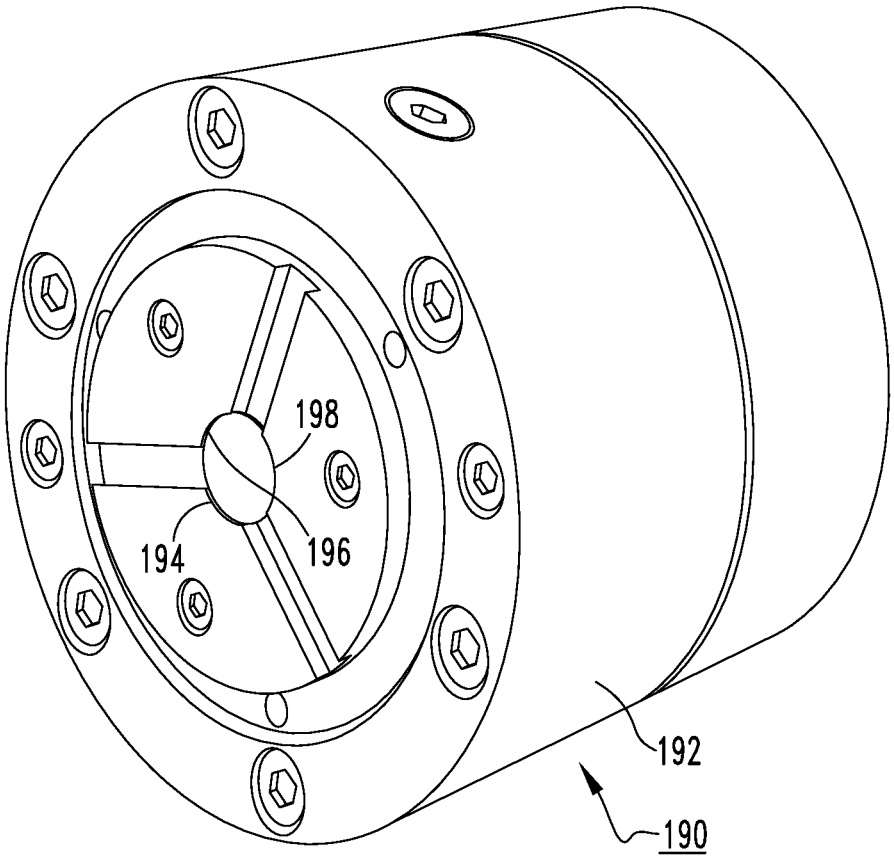
FIG. 7 is an isometric view of a chuck tool employed to assemble the charging ram assembly and pin assembly therefor of FIG. 6.

FIG. 7 shows an example chuck tool 190 that may be used to couple the retaining members 150,180 to the respective collar members 130,140,160,170. The chuck tool 190 includes a body 192 that has a plurality of internal edge portions 194,196,198. The internal edge portions 194,196, 198 are each spaced from each other and together define an opening that receives the retaining members 150,180. In order to couple the retaining members 150,180 to the respective collar members 130,140,160,170, the retaining members 150,180 are placed over and substantially enclose the respective collar members 130,140,160,170. In this position, a first position, the retaining members 150,180 engage the first and third portions 142,144 (and the corresponding portions of the collar members 130,160,170) and do not engage (i.e., are spaced from) the second portions 143 (FIG. 6) (and the corresponding second portions of the respective collar members 130,160,170). In order to couple the retaining members 150,180 to the respective collar members 130,140,160,170, the edge portions 194,196,198 move radially inwardly and drive (i.e., press and engage) the hook portions 151 (FIG. 6) (and the corresponding hook portion of the retaining member 180, shown but not indicated) of the retaining members 150,180 radially inwardly toward the second portions 143 to a second position (FIG. 6) (and the corresponding second portions of the respective collar members 130,160,170).

Although the disclosed concept is being described in association with the collar members 130,140,160,170 and the retaining members 150,180 on the respective end portions 114,116, it is within the scope of the disclosed concept to only employ the novel securing mechanism on only one of the end portions 114,116. For example and without limitation, it is within the scope of the disclosed concept to only employ the collar members 130,140 and the retaining member 150 on the end portion 114, and not employ the collar members 160,170 and the retaining member 180 on the end portion 116.

Figure 8:
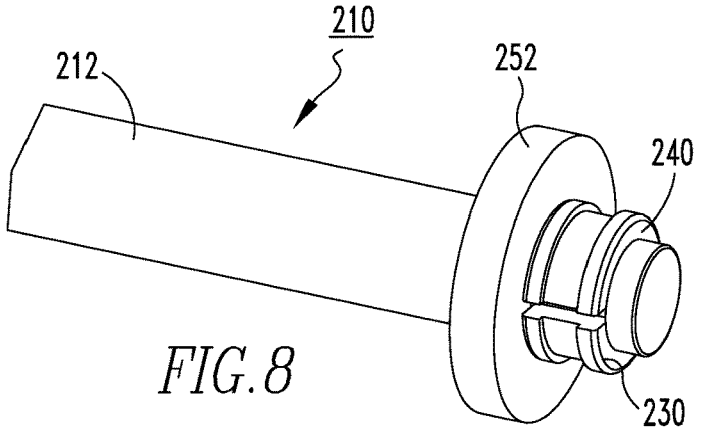
FIG. 8 is a front isometric view of a portion of a pin assembly, shown without a retaining apparatus in order to see hidden structures, in accordance with another non-limiting embodiment of the disclosed concept.
Figure 9:
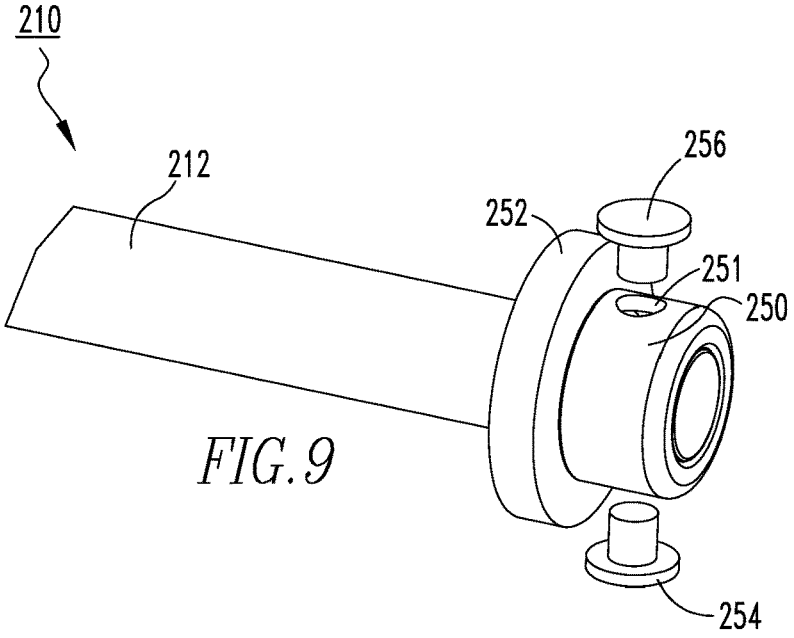
FIG. 9 is front isometric partially exploded view of the portion of the pin assembly of FIG. 8, also showing the retaining apparatus.
Figure 10:
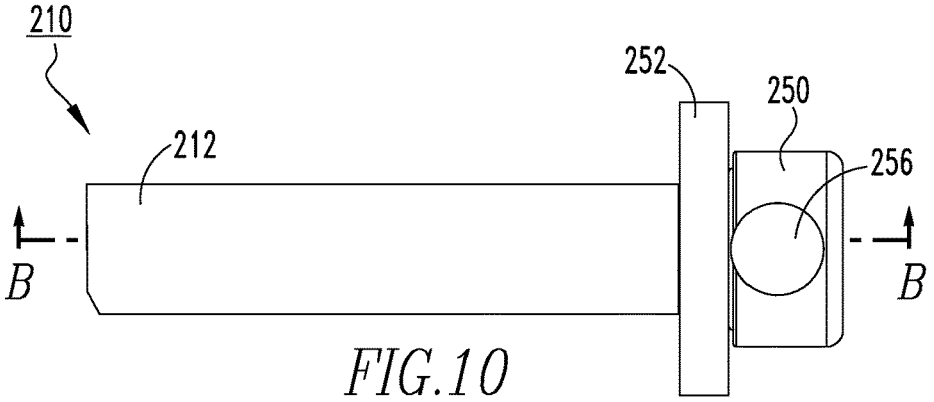
FIG. 10 is a top plan view of the portion of the pin assembly and retaining apparatus therefor of FIG. 9.

FIG. 8 shows a portion of another pin assembly 210 that may be used in the charging ram assembly 100 in place of the pin assembly 110. The pin assembly 210 includes a pin member 212 having the same hardness as the pin member 112, a plurality of semi annular-shaped collar members 230,240, and a securing apparatus. Referring to FIGS. 9 and 10, the securing apparatus of the pin assembly 210 is in the form of a retaining member 250, a washer 252, and a number of rivet members 254,256. As shown in FIG. 9, the retaining member 250 has a number of thru holes (only one thru hole 251 is shown). The rivet members 254,256 each extend through a corresponding one of the thru holes 251 and engage the collar members 230,240 in order to retain the collar members 230,240 on the pin member 212.

Figure 11:
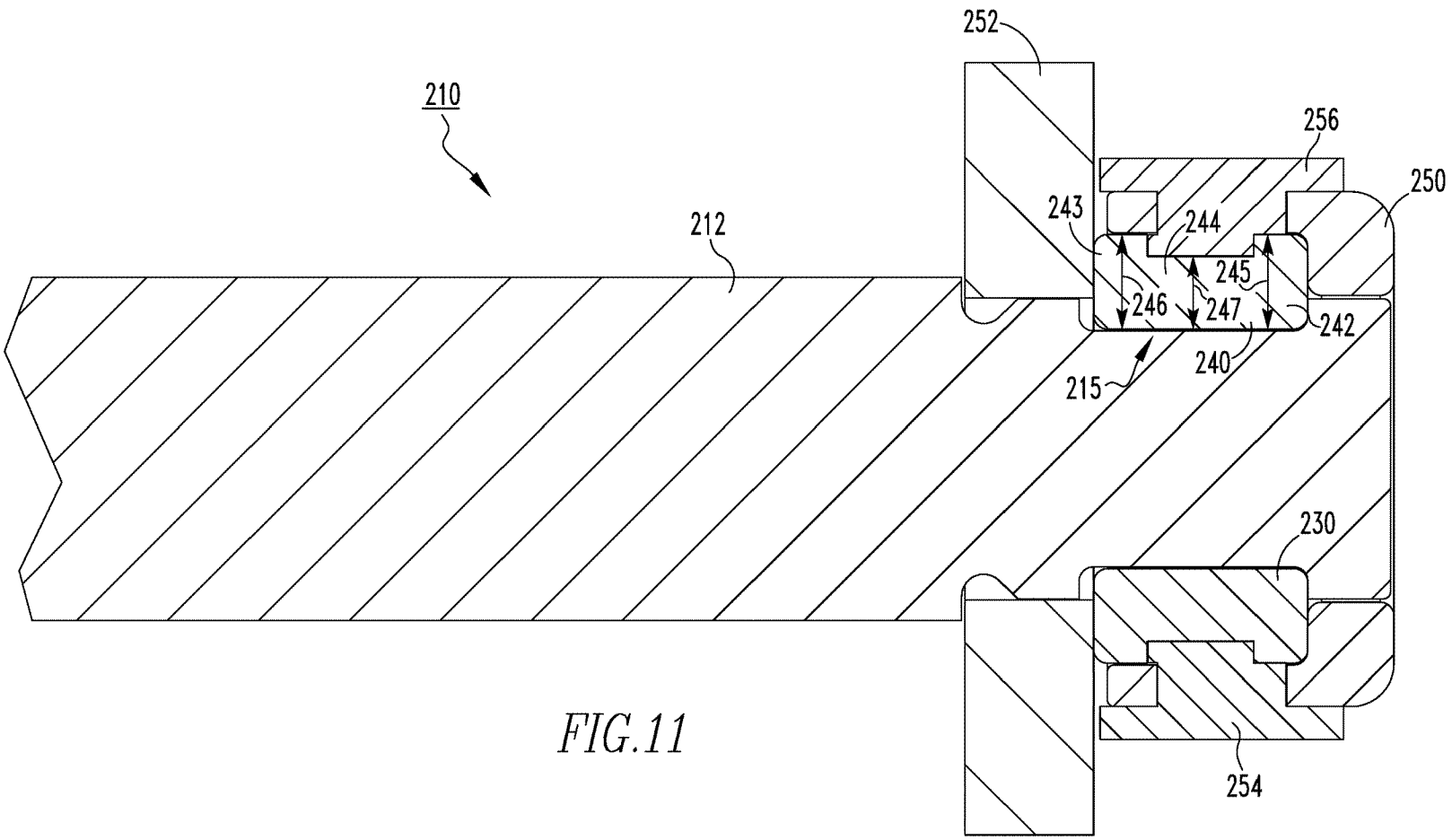
FIG. 11 is a section view of the portion of the pin assembly and retaining apparatus therefor of FIG. 10, taken along line B-B of FIG. 10.

More specifically, and with reference to FIG. 11, the collar member 240 has a pair of opposing disc-shaped portions 242,243 and another disc-shaped portion 244 extending between the portions 242,243. The portions 242,243 each have a width 245,246, and the portion 244 has a width 247 less than the widths 245,246. As seen in FIG. 11, the rivet member 156 engages the portion 244 and the rivet member 254 engages the corresponding portion (shown but not indicated) of the collar member 230. The instant configuration advantageously allows the collar members 230,240 and the retaining member 250 to be reliably secured to the pin member 212. For example, an undesirable longitudinal force attempting to separate the retaining member 250 from the collar members 230,240, such as a bias by the springs 102,103 (FIGS. 1-6) pressing the ram member 104 (FIGS. 1-6) into the washer 252, would result in the collar members 230,240 being driven into the pin member 212. More specifically, the pin member 212 has an annular-shaped grooved region 215 that is structured to exert a corresponding opposing normal force on the collar members 230,240 to the left in order to prevent movement (see, for example, the surface 118 in FIG. 6 and the associated discussion above). Thus, the example collar members 230,240 and the securing apparatus of the pin assembly 210 provides an additional non-limiting mechanism of prolonging the life of the circuit breaker 2. As a result, the pin assembly 210 provides significant advantages in terms of minimizing and/or eliminating over-travel of the ram member 104 in substantially the same manner as the collar members 130,140,160,170.

It will be understood that a non-limiting example method of securing one of the pin members 112,212 within the charging ram assembly 100 includes the steps of providing a respective one of the pin assemblies 110,210, extending the pin member 112,212 through the biasing element 102, 103 and the plate member 106, locating the first collar member 130,230 and the second collar member 140,240 on an end portion 114 of the pin member 112,212, and coupling the retaining member 150,250 to the first collar member 130,230 and the second collar member 140,240 in order to prevent the pin member 112,212 from moving with respect to the first collar member 130,230 and the second collar member 140,240. In one embodiment, the coupling step further includes substantially enclosing the first collar member 130 and the second collar member 140 with the retaining member 150, and employing the tool 190 to move the retaining member 150 from a first position to a second position. When the retaining member 150 moves from the first position toward the second position, the retaining member 150 moves radially inwardly toward the second portion 143. In another non-limiting embodiment, the coupling step further includes inserting a number of rivet members 254, 256 through the retaining member 250, and engaging each of the rivet members 254,256 with one of the collar members 230,240.

Accordingly, it will be appreciated that the disclosed concept provides for an improved (e.g., without limitation, longer lasting, more reliable) charging ram assembly 100, and pin assembly 110,210 and securing method therefor, in which a plurality of collar members 130,140,160,170,230, 240 and a securing apparatus significantly prolongs and/or eliminates the onset of fracture in a pin member 112,212, thereby preventing over-travel of a ram member 104 with respect to the pin member 112,212.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A pin assembly for a charging ram assembly of an electrical switching apparatus, said charging ram assembly comprising a biasing element, a ram member structured to bias said biasing element, and a plate member, said pin assembly comprising:

a pin member structured to extend through said biasing element and said plate member, said pin member having a first end portion and a second end portion disposed opposite and distal from said first end portion;

a plurality of collar members comprising a first collar member and a second collar member each being coupled to said first end portion, each of said first collar member and said second collar member comprising a first disc-shaped portion, a second disc-shaped portion disposed opposite the first portion, and a third disc-shaped portion extending between the first portion and the second portion; and a securing apparatus comprising a retaining member coupled to said first collar member and said second collar member in order to prevent said pin member from moving with respect to said first collar member and said second collar member, wherein the first portion, the second portion, and the third portion each have a width; and wherein the width of the third portion is less than the width of the first portion and the width of the second portion.

2. The pin assembly of claim 1 wherein said retaining member further has a number of thru holes; wherein said securing apparatus further comprises a number of rivet members each extending through a corresponding one of the number of thru holes; and wherein each of said number of rivet members engages a respective third portion of a respective one of said first collar member and said second collar member.

3. The pin assembly of claim 2 wherein each of said number of rivet members is spaced from said pin member.

4. The pin assembly of claim 1 wherein said first end portion has an annular-shaped grooved region; and wherein each of said first collar member and said second collar member is disposed in said grooved region.

5. The pin assembly of claim 4 wherein each of said first collar member and said second collar member is semi annular-shaped.

6. The pin assembly of claim 5 wherein said first collar member is concave facing said second collar member; and wherein said second collar member is concave facing said first collar member.

7. The pin assembly of claim 5 wherein each of said first collar member and said second collar member is concentric with said grooved region.

8. The pin assembly of claim 4 wherein said grooved region comprises a first disc-shaped-surface, a second disc-shaped surface disposed opposite said first surface, and a third cylindrical-shaped surface extending between and being perpendicular to the first surface and the second surface; wherein each of said first collar member and said second collar member is flush with the third surface; and wherein each of said first collar member and said second collar member is structured to engage the first surface in order to prevent said pin member from moving with respect to said first collar member and said second collar member.

9. The pin assembly of claim 4 wherein said securing apparatus further comprises a washer; wherein said grooved region has a first region and a second region extending from the first region; wherein the first region and the second region each have a diameter; wherein the diameter of the second region is greater than the diameter of the first region; wherein said washer is concentric with the second region; and wherein each of said first collar member and said second collar member is concentric with the first region.

10. The pin assembly of claim 1 wherein said plurality of collar members further comprises a third collar member and a fourth collar member each coupled to said second end portion; and wherein said securing apparatus further comprises a second retaining member coupled to said third collar member and said fourth collar member in order to prevent said pin member from moving with respect to said third collar member and said fourth collar member.

11. The pin assembly of claim 1 wherein said first collar member does not engage said second collar member.

12. The pin assembly of claim 1 wherein said first collar member, said second collar member, and said retaining member are not threadably connected to said pin member.

13. The pin assembly of claim 1 wherein said pin member has a Rockwell Hardness greater than RC 45.

14. A charging ram assembly for an electrical switching apparatus, said charging ram assembly comprising:

a biasing element;

a ram member structured to bias said biasing element;

a plate member; and a pin assembly comprising:

a pin member extending through said biasing element and said plate member, said pin member having a first end portion and a second end portion disposed opposite and distal from said first end portion, a plurality of collar members comprising a first collar member and a second collar member each being coupled to said first end portion, each of said first collar member and said second collar member comprising a first disc-shaped portion, a second disc-shaped portion disposed opposite the first portion, and a third disc-shaped portion extending between the first portion and the second portion, and a securing apparatus comprising a retaining member coupled to said first collar member and said second collar member in order to prevent said pin member from moving with respect to said first collar member and said second collar member, wherein the first portion, the second portion, and the third portion each have a width; and wherein the width of the third portion is less than the width of the first portion and the width of the second portion.

15. The charging ram assembly of claim 14 wherein said plate member comprises a first surface and a second surface parallel to the first surface; wherein the first surface and the second surface face away from one another; wherein the first surface faces said biasing element and said ram member; and wherein the second surface faces each of said first collar member, said second collar member, and said retaining member.

16. A method of securing a pin member within a charging ram assembly of an electrical switching apparatus, said charging ram assembly comprising a biasing element, a ram member structured to bias said biasing element, and a plate member, the method comprising the steps of:

providing a pin assembly comprising said pin member, a first collar member, a second collar member, and a retaining member, said pin member having a first end portion and a second end portion disposed opposite and distal from said first end portion, each of said first collar member and said second collar member comprising a first disc-shaped portion, a second disc-shaped portion disposed opposite the first portion, and a third disc-shaped portion extending between the first portion and the second portion;

extending said pin member through said biasing element and said plate member;

disposing said first collar member and said second collar member on said first end portion; and coupling said retaining member to said first collar member and said second collar member in order to prevent said pin member from moving with respect to said first collar member and said second collar member, wherein the first portion, the second portion, and the third portion each have a width; and wherein the width of the third portion is less than the width of the first portion and the width of the second portion.

17. The method of claim 16 wherein the coupling step comprises:

inserting a number of rivet members through said retaining member; and engaging each of said number of rivet members with one of said first collar member and said second collar member.

18. The method of claim 17 wherein each of said number of rivet members is spaced from said pin member.

* * * * *